United States Patent [19]

French et al.

[11] Patent Number: 4,543,041

[45] Date of Patent: Sep. 24, 1985

[54] IMPELLOR FOR CENTRIFUGAL COMPRESSOR

[75] Inventors: Pierre B. French; Paul J. Langdon, both of West Yorkshire, England

[73] Assignee: Holset Engineering Company Limited, Turnbridge, England

[21] Appl. No.: 690,419

[22] Filed: Jan. 10, 1985

Related U.S. Application Data

[63] Continuation of Ser. No. 405,574, Aug. 5, 1982, abandoned.

[30] Foreign Application Priority Data

Aug. 13, 1981 [GB] United Kingdom ..... 8124143

[51] Int. Cl.[4] ..... F04D 17/10

[52] U.S. Cl. ..... 416/183; 416/203; 416/223 B; 416/242; 415/212 R

[58] Field of Search ..... 416/242, 243, 223 B, 416/202, 203, 183, 185, 188; 415/212 R, 214, 215

[56] References Cited

U.S. PATENT DOCUMENTS

| | | | |
|---|---|---|---|
| 2,354,653 | 8/1944 | Allen | 416/243 |
| 3,069,072 | 12/1962 | Birmann | 416/183 |
| 3,260,443 | 7/1966 | Garnett | 416/182 |
| 3,782,857 | 1/1974 | Svilans | 416/243 |
| 4,167,369 | 9/1979 | Ishihara | 416/183 |
| 4,243,357 | 1/1981 | Flynn | 415/215 |

FOREIGN PATENT DOCUMENTS

| | | | |
|---|---|---|---|
| 62417 | 6/1944 | Denmark | 416/223 B |
| 1059245 | 6/1959 | Fed. Rep. of Germany | 416/183 |
| 2524710 | 5/1975 | Fed. Rep. of Germany . | |
| 1375168 | 9/1964 | France . | |
| 234200 | 12/1944 | Switzerland | 416/223 B |
| 269886 | 11/1950 | Switzerland | 416/223 B |
| 512098 | 8/1939 | United Kingdom | 416/223 B |
| 796599 | 6/1958 | United Kingdom | 416/223 B |

*Primary Examiner*—Samuel Scott
*Assistant Examiner*—B. J. Bowman
*Attorney, Agent, or Firm*—Gary M. Gron; Robert T. Ruff

[57] ABSTRACT

An impeller for a centrifugal impeller comprising a disc portion, a coaxial hub portion having a longitudinal through-bore by which the impeller is mounted on a rotatable shaft, and a plurality of blades in any one of several forms. The tip of each blade is curved in a direction opposite to the rotation of the impeller more than the rest of the blade. The radius of the tip curve decreases uniformly toward the radially outer end of the blade. This tip treatment produces improved isentropic efficiency.

5 Claims, 7 Drawing Figures

IMPELLOR FOR CENTRIFUGAL COMPRESSOR

This application is a continuation of application Ser. No. 405,574, filed Aug. 5, 1982, now abandoned.

BACKGROUND

The present invention relates to impellers for centrifugal compressors and is concerned in particular with the shape of the vanes or blades of such impellers.

Typical compressor impellers currently in use comprise a hub portion adapted to be mounted on a rotatable drive shaft and integrally connected to a coaxial disc portion which lies in a plane perpendicular to the axis of rotation of the hub. A series of vanes or blades are mounted on the front face of the disc and hub portions for imparting to air or other gases supplied to the impeller the required motion generally radially outwardly relative to the disc portion. For this purpose, the vanes or blades themselves extend generally outwardly from the hub portion although many variations are possible. For example, the vanes or blades may be truly radial or they may be backswept relative to a radial direction. Such backswept blades can be curved or straight. Frequently, the vanes or blades consist of main blades interspaced with so-called splitter blades which are of shorter axial length than the main blades.

It is an object of the present invention to provide a modified form of blade or vane shape which results in increased isentropic efficiency for the impeller.

SUMMARY OF INVENTION

In this invention, the blades of a conventional compressor impeller are modified such that: (a) if the blade is truly radial, it is provided with a backswept tip portion; (b) if the blade is straight and backswept, it is provided with an additionally backswept tip portion; or (c) if the blade is curved and backswept it is provided with an additionally backswept tip portion where curvature is increased relative to the curvature of the major part of the blade. The curve of the backswept tip portion in case (a) and of the additional backswept tip portion in cases (b) and (c) which defines the front or leading (pressure) surface of the blade is such that the radius of the curve decreases uniformly towards the radially outer end of the blade, whereby the minimum radius of the curve occurs at the radially outer end of the blade. This results in the velocities of the fluid adjacent the leading surface of each blade and of the fluid adjacent the trailing surface of each blade having more nearly equivalent velocities at the point of the mixing of the two fluids at the radially outer end.

DESCRIPTION OF THE PREFERRED EMBODIMENTS

Figure 1:
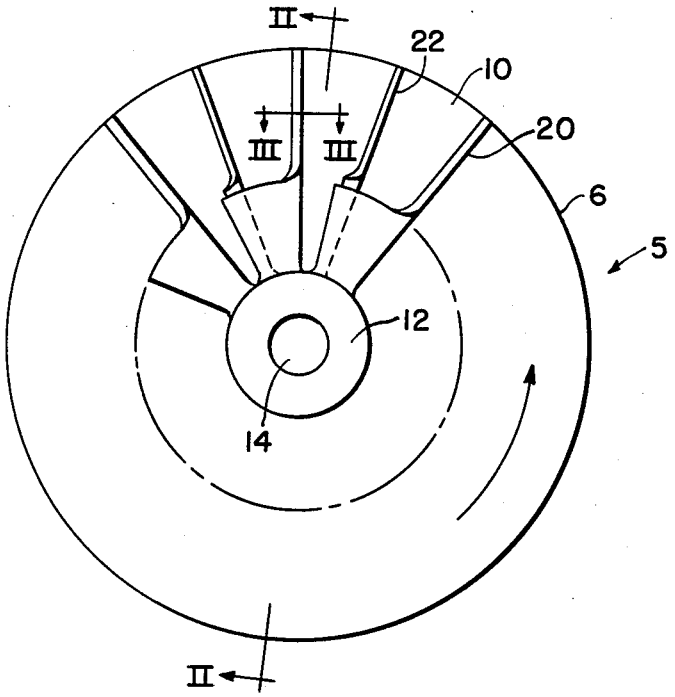
FIG-1 PRIOR ART
FIG. 1 is a front view (showing a plane which is perpendicular to the rotational axis) of a typical prior art radial vane impeller.
Figure 2:
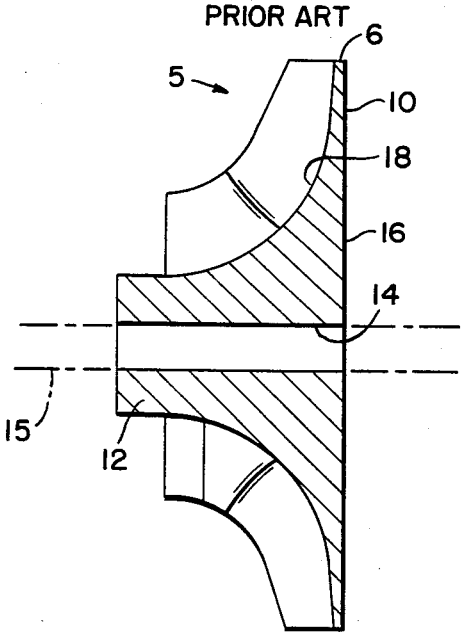
FIG-2 PRIOR ART
FIG. 2 is a longitudinal section view on line I—I of FIG. 1 showing a plane which contains the rotational axis of the impeller.
Figure 3:
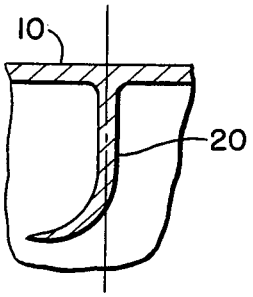
FIG-3 PRIOR ART
FIG. 3 is a partial section on line II—II of FIG. 1.

The prior art impeller 5 of FIGS. 1 to 3 comprises a disc portion 10 which merges smoothly with a coaxial hub portion 12 having a longitudinal through-bore 14 by which the impeller 5 is mounted on a rotatable drive shaft 15. The rear face 16 of the disc portion 10 is plain. The front curved surface 18 defined by the disc and hub portions 10,12 of the impeller 5 carries a plurality of generally forwardly extending main vanes or blades 20 (hereinafter referred to as blades) which, in this embodiment, extend truly radially relative to the axis of rotation. Blades 20 have an inlet portion 21 in which air enters substantially in an axial direction as viewed in FIG. 2 and a tip portion, to be described later, through which air passes substantially radially outward, also as viewed in FIG. 2. Such blades are not subject to bending moments during rotation of the impeller. The illustrated impeller 5 also includes a plurality of additional blades or vanes 22 interspaced with the main blades 20, these additional vanes or blades being of shorter axial length and being referred to commonly as splitter blades 22.

In other prior art impellers, the blades 20 and 22 are not purely radial but may be backswept relative to the radial direction.

In all prior art impellers 5, the tip portions of the blades (i.e. the portions close to the periphery 6 of the impeller 5) are either (1) straight and truly radial, (2) straight and backswept relative to the radial direction, or (3) backswept and curved relative to the radial direction, the curvature of the tip portions being constant along their length.

In accordance with the invention, (1) if the blades are straight and radial, backsweep is introduced at the leading surface of the tip portions, (2) if the blades are straight and already backswept, a small amount of additional backsweep is introduced at the leading surface of the tip portions, or (3) if the blades are curved and backswept the leading surface of the tip portions is arranged to be of increased curvature.

Figure 4:
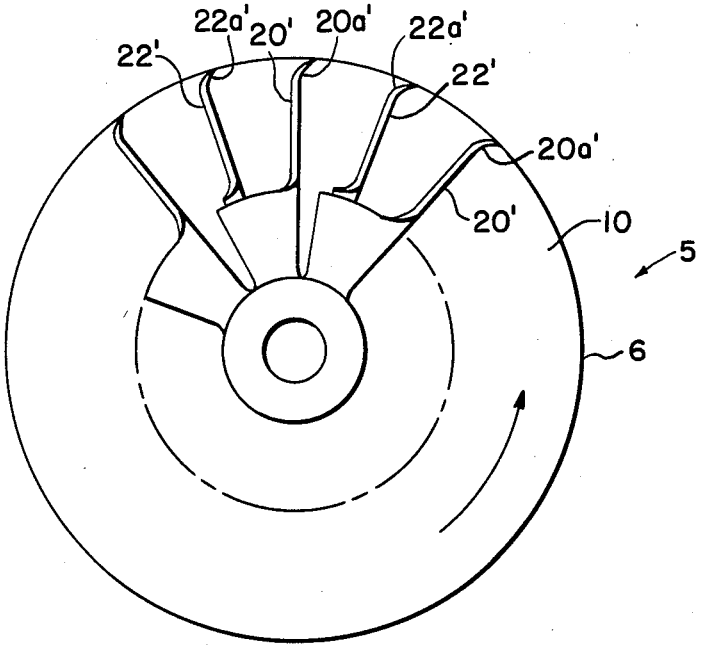
FIG. 4 is a front view of one embodiment of an impeller in accordance with the present invention.

FIG. 4 illustrates an example of type (1) above. Thus, it includes a plurality of main blades 20' and splitter blades 22' which are purely radial over the majority of their length. However, in accordance with the invention, tip portions **20*a'* and 22*a'*** are backswept.

Figure 5:
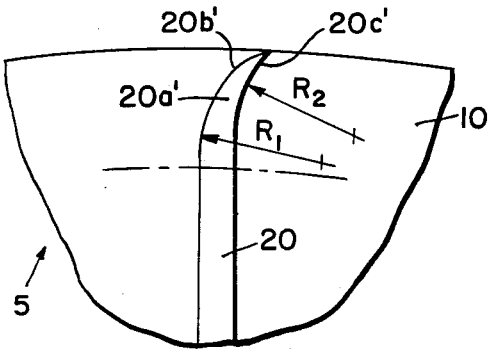
FIG. 5 is an enlarged fragmentary view of the impeller of FIG. 4 illustrating the blade tip in more detail.

FIG. 5 is an enlarged scale view of the blade tip portion **20*a'*. It will be noted that the backsweep or curvature applied to these tip portions 20*a'* is defined by two curves (defined by the leading and trailing surfaces 20*b'*,20*c'*) which intersect the impeller periphery 6**. The radii of curvature of these surfaces are denoted by $R_1$ and $R_2$, respectively.

The curve ($R_1$) which defines the leading, or pressure, surface of the blade 20 is such that the radius of the curve decreases uniformly, considered in the radially outward direction, whereby the minimum radius is at the point where the surface intersects the line of the impeller periphery 6.

The curve ($R_2$) defining the back face of the blade 20 may be any convenient form which joins the radial back face of the blade to the region where the curve of the front face of the blade intersects the impeller periphery 6.

Figure 6:
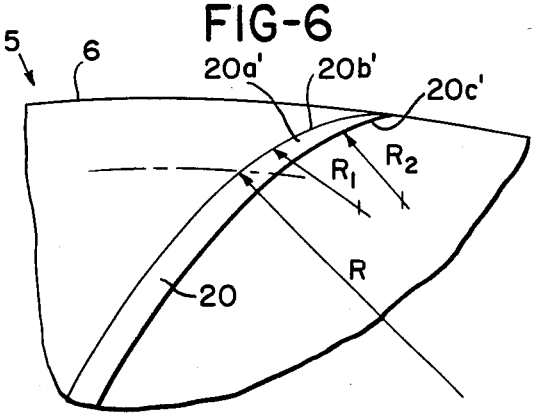
FIG. 6 is a view similar to FIG. 5 but showing a backward curved impeller blade to which the invention has been applied.

FIG. 6 illustrates an example of type (3) above where an already backswept curved impeller blade has an additionally backswept tip portion 20*a*′. In this type of impeller 5, the radii $R_1$, $R_2 \ldots R_n$ must all be less than the radius $R_o$ which defines the curvature of the normal blade surface at the point where the additional backsweep in accordance with the invention begins. In such an embodiment:

$$R_1 > R_2 > R_3 > \ldots > R_n$$

Figure 7:
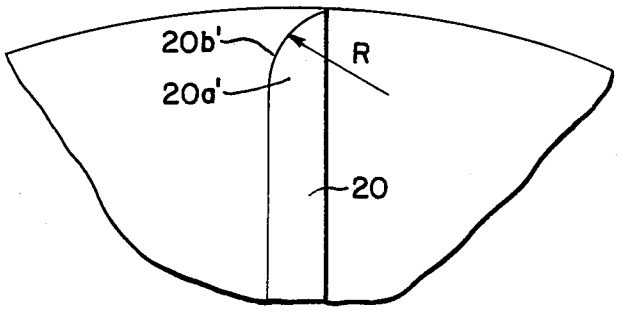
FIG. 7 is a view corresponding to FIG. 5 but showing a particularly simple form of the invention.

Perhaps the simplest example incorporating the invention is that shown in FIG. 7 where an existing radial blade 20 has its leading or pressure surface 20*b*′ machined back by suitable manufacturing processes so as to form a curved surface of uniformly decreasing radius R.

The descriptions of the tip portion 20*a*′ of the impeller blade 20 in FIGS. 5, 6 and 7 also apply to the tip portion 22*a*′ of a splitter blade 22 for each type of impeller blade design.

In all cases, the addition of an increasingly backswept tip to an otherwise conventional impeller has been found to result in increased compressor isentropic efficiency by increasing the velocity of the high pressure, low velocity fluid adjacent the leading surface of each blade to be more nearly equivalent at the radially outer end of the blade to the velocity of the low pressure, high velocity fluid adjacent the trailing surface. The fluid adjacent the trailing surface decreases in velocity if the trailing surface is backswept also as shown in FIGS. 4, 5, and 6 resulting in the velocities becoming even more nearly equivalent than if only the leading edge is backswept.

It should be apparent to those skilled in the art that the principle of decreasing the radius of the curvature of the leading edge of the blade of any form of impeller for a centrifugal compressor will produce a similar increase in isentropic efficiency.

Having thus described the invention what is claimed as novel and desired to be secured by Letters Patent of the United States is:

1. An impeller for a centrifugal compressor, said impeller comprising:

an annular disc portion having a front face and a rear face;

an integral coaxial hub portion rotatable about a central axis; and a plurality of blades mounted on the front face of the disc portion and on the hub portion, each blade having a leading and trailing surface;

each of said blades having an inlet portion for substantially axial entry of fluid and a tip portion for substantially radial movement of fluid as viewed in a plane containing the central axis of said impeller, the leading surface of the tip portion curving in a direction away from the direction of tip portion movement as viewed in a plane perpendicular to the central axis of said impeller, the radius of curvature of said leading surface uniformly decreasing to a minimum radius of curvature at the outer end of said blade that is less than any curvature radially inward from said tip portion.

2. An impeller as in claim 1 in which substantially the entire leading face of the blade radially inward from said tip portion curves opposite the direction of rotation of the impeller.

3. An impeller as in claim 1 in which the portion of the blades between said tip portion and the inlet portion extend radially and are straight except for the tip portion and both leading and trailing faces of said tip portion curve opposite the direction of rotation of the impeller.

4. An impeller as in claim 1 in which both leading and trailing surfaces of the blades radially inward from said tip portion are curved.

5. An impeller as in claim 1 further comprising a plurality of splitter blades mounted on the front face of the disc portion and on the hub portion and extending to the periphery of the disc portion, said splitter blades being placed between the blades so that the splitter blades and blades alternate, said splitter blades each having a tip portion for substantially radial movement of fluid as viewed in a plane containing the central axis of said compressor, said splitter blades having a leading surface which, in the tip portion, curves in a direction away from the direction of tip section movement as viewed in a plane perpendicular to the central axis of said hub portion, the radius of curvature of said leading surface uniformly decreasing to a minimum radius of curvature at the outer end of said blade that is less than any curvature radially inward from said tip section.

* * * * *